US005480323A

United States Patent [19]

Mews et al.

[11] Patent Number: 5,480,323

[45] Date of Patent: Jan. 2, 1996

[54] CONNECTION STRUCTURE FOR AT LEAST ONE ELECTRICAL DEVICE

[75] Inventors: Hans-Peter Mews; Norbert Rüster, both of Lüdenscheid, Germany

[73] Assignee: Vossloh-Schwabe GmbH, Urbach, Germany

[21] Appl. No.: 230,056

[22] Filed: Apr. 20, 1994

[30] Foreign Application Priority Data

Apr. 20, 1993 [DE] Germany ..... 43 12 781.9

[51] Int. Cl.[6] ..... H01R 4/24

[52] U.S. Cl. ..... 439/395; 439/620

[58] Field of Search ..... 439/395–405, 439/709–715, 721, 723, 725, 620

[56] References Cited

U.S. PATENT DOCUMENTS

| | | | |
|---|---|---|---|
| 4,130,331 | 12/1978 | Neff et al. . | |
| 4,159,158 | 6/1979 | Weidler . | |
| 4,212,509 | 7/1980 | Brooks et al. . | |
| 4,927,379 | 5/1990 | Wang et al. | 439/398 |

FOREIGN PATENT DOCUMENTS

| | | |
|---|---|---|
| 0002099A1 | 5/1979 | European Pat. Off. . |
| 0109297A1 | 5/1984 | European Pat. Off. . |
| 0407892A3 | 1/1991 | European Pat. Off. . |
| 1745656 U | 5/1957 | Germany . |
| 1246078 | 8/1967 | Germany . |
| 7416664 U | 11/1974 | Germany . |
| 2604241 | 8/1976 | Germany . |
| 2701403 | 7/1977 | Germany . |
| 81 23 223.3 | 1/1982 | Germany . |
| 3818497A1 | 12/1989 | Germany . |
| 3922431A1 | 1/1991 | Germany . |

*Primary Examiner*—David L. Pirlot

*Attorney, Agent, or Firm*—Frishauf, Holtz, Goodman, Langer & Chick

[57] ABSTRACT

An electric connection structure for at least one electric device has slit blade insulation piercing connectors (5) and additional plug connectors (31) for connecting conductive parts.

28 Claims, 9 Drawing Sheets

FIG.14
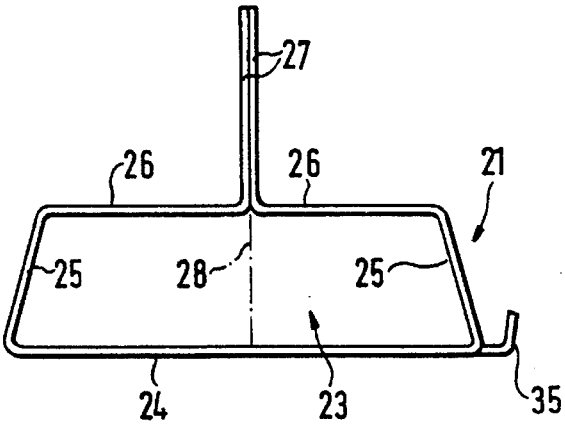
FIG.17
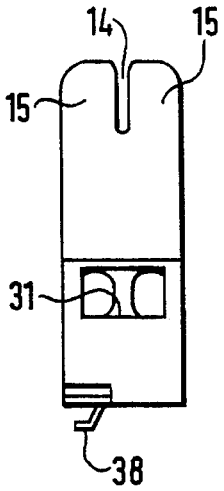
FIG.15
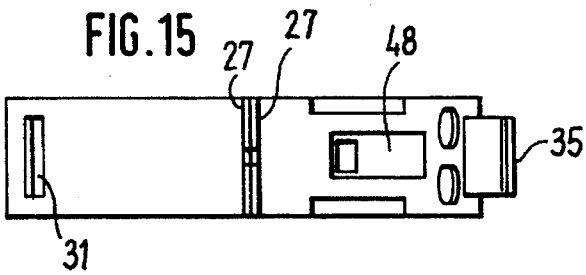
FIG.16
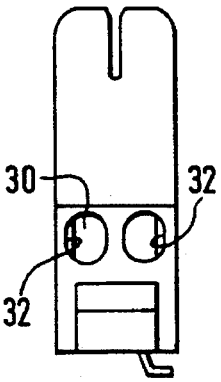
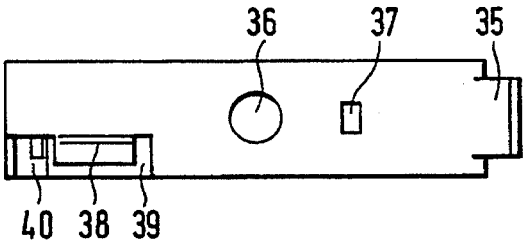
FIG.18

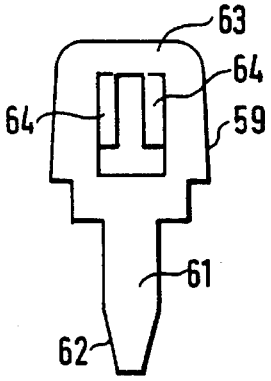
FIG. 19
FIG.23
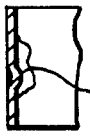
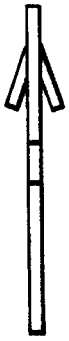
FIG.20
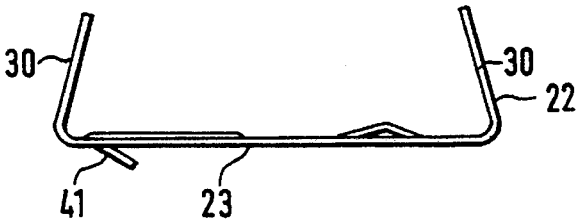
FIG. 24
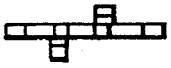
FIG.21
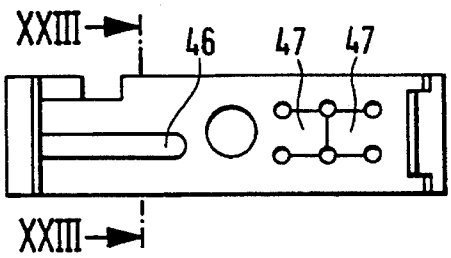
FIG.22

CONNECTION STRUCTURE FOR AT LEAST ONE ELECTRICAL DEVICE

Reference to relates application, the disclosure of which is hereby incorporated by reference:

U.S. application Ser. No. 08/227,613, Hammer et al., filed Apr. 14, 1994.

Reference to related publication: EP 002 099, Leidy et al.

FIELD OF THE INVENTION

The invention relates to a connection structure for at least one electrical device, having a housing with fastening devices and comprising electrically insulated material and having contact means that have electrically conductively joined but, spatially separated connection points for electrically conductive parts, of which at least one connection point is formed as a slit blade insulation-piercing connector.

BACKGROUND

From EP 002 099, Leidy, for instance, a connection structure for an electrical low-voltage transformer is known, which has a housing made of insulating material and arranged for fastening to the lamination stack of the transformer; accommodated in the housing, as contact means, are a number of electrically conductive contact springs, each of which has an insulation-piercing slit for connection of an external conductor by slit blade insulation piercing connection technology. In addition, the contact springs are provided with a further insulation-piercing slit, likewise forming a slit blade insulation piercing connector, which makes it possible to attach a substantially thinner wire of the coil winding, so as to make an electrically conductive connection between the external conductor and the winding. Assembly is done in such a way that first the housing is secured to the lamination packet, and then the wire ends coming from the winding are inserted into slits in the housing. Next, the contact springs are inserted by pressure from above into corresponding chambers of the housing associated with the slits; on the one hand, this presses the wire ends into the associated insulation piercing slits, and on the other the contact springs are locked in place in the chambers of the housing. In an ensuing step, finally, the external supply line wires can be inserted into the externally accessible insulation piercing slits of the contact springs, As a rule, assembly of the housing and of the contact spring must therefore already be done by the manufacturer of the transformer unit.

In wiring electrical fixtures or luminaires with a three-pole connection clamp for gas discharge lamps, e.g., fluorescent lamps, it was previously necessary to join a considerable number of separate connection points together by their own lines, because the arrangement includes not only a separate connection block, but also additional connection points for capacitors and other necessary accessories. Hence the wiring process is costly and labor-intensive.

THE INVENTION

It is an object to provide a connection structure for at least one electrical operating element or device, such as a capacitor, which makes it possible to reduce the expense and effort for wiring and moreover which can be used universally for various applications.

Briefly, at least one further connection point of the contact means is formed as a plug connector, and both connection points, that is, both the slit blade insulation piercing connector and the plug connector, are insulated and protected at least against accidental contact, i.e., are shock hazard protected, by surrounding housing parts in the housing.

The slit blade insulation piercing connector makes possible the easy connection of conductors of the wiring by slit blade insulation piercing connection technology, which is especially suitable for automatic production of wiring layouts by means of a program-controlled robot and a wire placement tool moved by the robot along the wire placement paths. The at least one plug connector makes it possible simply to plug in a suitable power supply line for an electrical device—or some other wire or line— without requiring additional connectors that would have to be triggered by the wire placement tool.

For instance, at least one plug connector may be arranged for the insertion of a solder lug or of a blade connector, and the arrangement is often made such that it has two plug connectors, located side by side, which are arranged for insertion of a solder tug or blade connector and each of which is electrically conductively joined to its own slit blade insulation piercing connector. In this way, it is possible for instance for an electrolyte capacitor equipped with the usual two soldered lugs to be connected directly to the connection structure, so that its own connectors to be mounted in the apparatus and then wired can be dispensed with. Resistors, chokes and accessories or other devices can also be connected at those points by means of a blade connector or at other suitably arranged connection structures directly via their connection wires or optionally associated pin connectors.

With a view to automatic wiring and the requisite freedom of motion for the wire placement tool, it is often advantageous if the connection structure has at least one plug connector, whose insertion direction is located at right angles to the insertion direction of the slit blade insulation piercing connector. Moreover, at least one receiving or connection region for the device may be provided on the housing, and at least one plug connector is located in its region, and which makes it possible to connect the device that is to be connected directly mechanically to the housing as well. To that end, the receiving or connection region may have mechanical stop or retaining means for the device.

To increase the universal utility of the connection structure, it is suitable for the receiving or retaining region to be covered, insulated from outside, by detachable closure means, if the connection structure is used without a device to be connected at that point.

DRAWING

Exemplary embodiments of the subject of the invention are shown in the drawing.

FIGS. 14–18 are a side view, a top view, two views from both face ends, and a view from below, respectively, of a contact spring of the connection structure of FIG. 1;

FIGS. 19–21 are a plan view, a side view and a view from the top of a ground connection structure for the connection structure of FIG. 1;

FIGS. 22–24 are a side view, a view from the top and a sectional view along the line XXIV—XXIV of FIG. 23 of the clamping spring for the contact spring of FIGS. 14–18;

DETAILED DESCRIPTION

Figure 1:
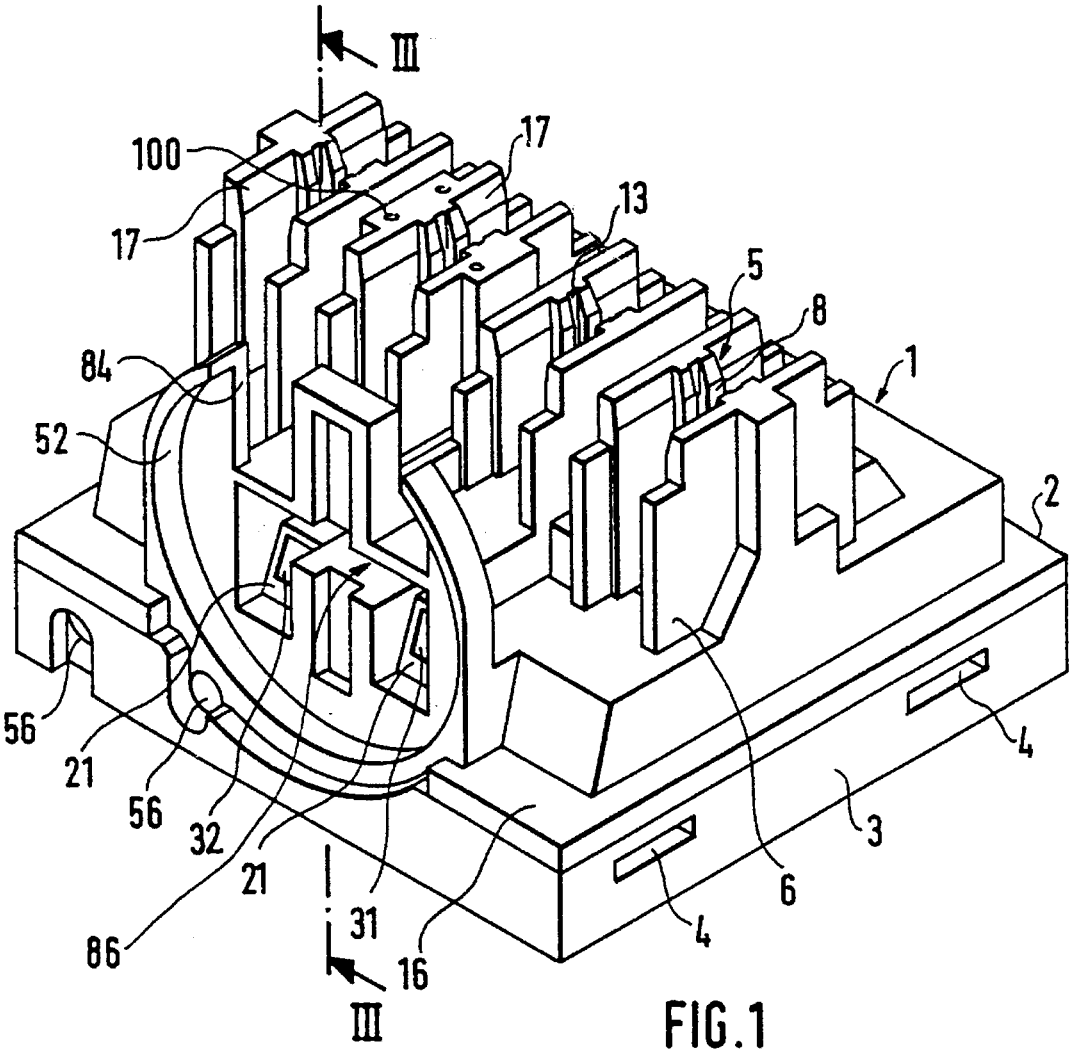
FIG. 1 is a perspective view of a connection structure according to the invention with the closure part removed.
Figure 5:
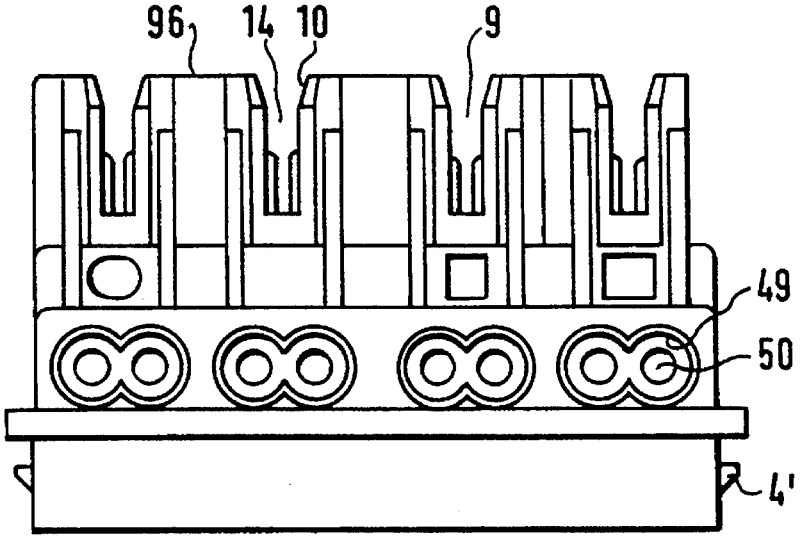
FIG. 5 is a side view from the side opposite the closure element of the connection structure of FIG. 1.

The connection structure shown in FIG. 1 has a housing 1, made in one piece of plastic, with a rectangular base part 2, onto the bottom of which a caplike cover 3 is mounted, which is locked in detent fashion at two opposed face ends, via detent recesses 4 and detent protrusions 4 provided on the base part 2 (see FIGS. 1, 5). Five connection terminals 5 are formed onto the base part 2, located side by side in a row, each of which is defined by two parallel walls 6 facing one another in spaced-apart fashion. The connection terminals 5 are arranged for connecting wires 7 by the so-called slit blade insulation piercing connection technique and are essentially identical in design.

In each of the connection terminals 5, the two parallel side walls 6 define a terminal housing that is open at the top. On their inside, they have two opposed formed-on ribs 8, which are located approximately in the middle between the two face ends of the side walls 6 and between them define a slightly wedge-shaped or parallel-sided insertion slit 9 (FIG. 5), which is widened on top by insertion slopes 10. On its bottom 11, the insertion slit 9 is located in somewhat raised fashion compared with the bottom parts 12, adjoining it on both sides, of the chamber defined by the two side walls 6, as can be seen from FIG. 3.

Extending into the ribs 8 from below to approximately the height of the insertion slopes 10 are two opposed narrow grooves 13, which receive the paired legs 15, each defining one insulation piercing slit 14 open at the edge, of two slit blade insulation piercing contacts 16 (FIG. 26) of a contact spring 21 made of spring steel or spring bronze. The narrow slit blade insulation piercing contacts 16, in the form of small plates, are embedded on the narrow side in the insulating material of the housing 1 between the side walls and in the grooves 13, except for the cutting segments formed on the legs 15 and oriented toward the insulation piercing slit 14; the legs 15 are guided in the grooves 13 so as to be movable to a limited extent. Together with the insulation piercing slit 14, they form the contacting zone of the connection point formed by the respective connection terminal 5.

Figure 3:
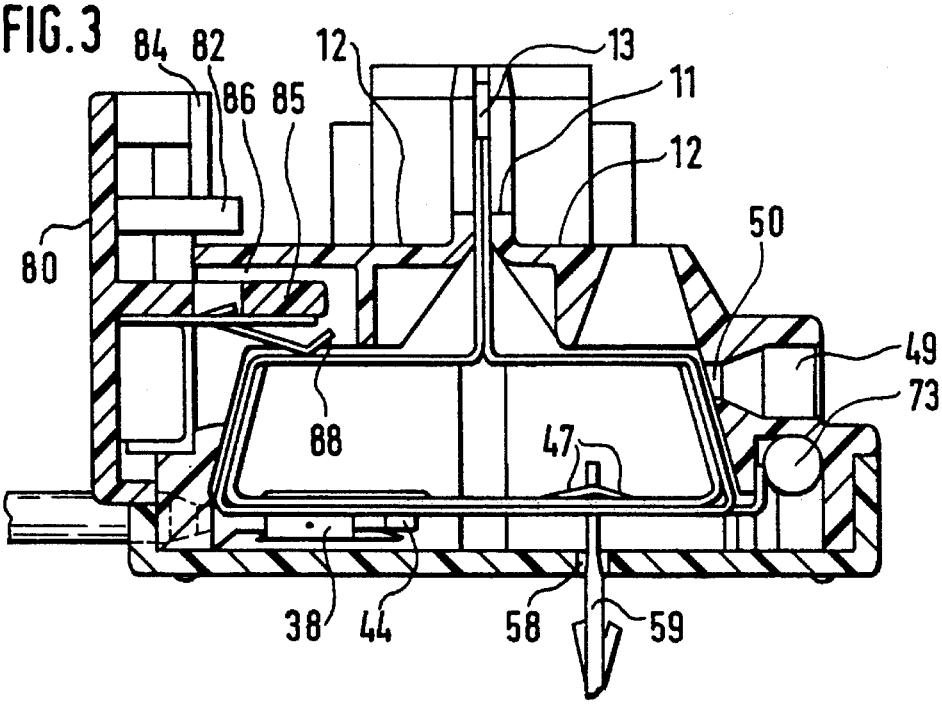
FIG. 3 is a sectional view from the side, cut along the line III—III of FIG. 1, of the connection structure of FIG. 1, with the closure element inserted and showing the connection conditions for a ground connection and a wire.

As can be seen especially from FIGS. 1, 3 and 5, the side walls 6 together with the associated bottom wall 12 form one groovelike indentation of rectangular cross section adjoining the ribs 12 and hence the insertion slit 9 on each side; the indentation is open toward the top next to the insertion slit 9. The two groovelike indentations 17 on both sides of the insertion slit 9 are in alignment with one another and with the insertion slit. They are likewise limited at the top by an insertion slope 10. As shown in FIG. 3, for instance, the depth of the groovelike indentations 17 is greater than that of the insertion slit 9, and their width is likewise substantially greater than the width of the insertion slit 9 (see FIG. 5).

Figure 26:
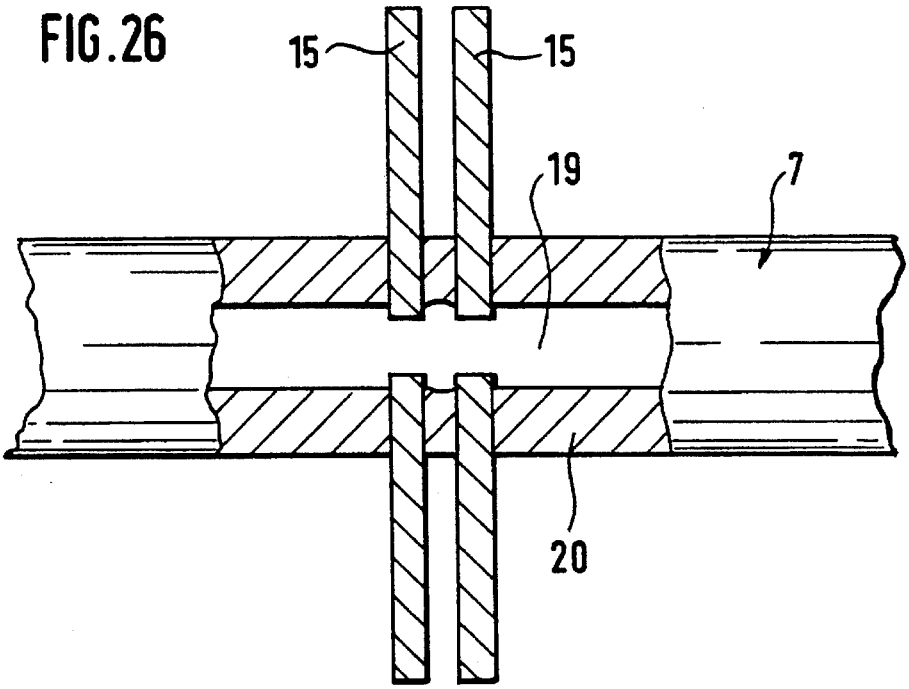
FIG. 26 shows a plan view of a detail, on a different scale, of a connector of a slit blade insulation piercing contact of the connection structure of FIG. 1.

The dimensions of the various parts are chosen such that in an insulated conductor pressed through the insertion slit 9 (see FIG. 4), the insulation is cut open in the insulation piercing slit 4 by the legs 15 of the two slit blade insulation piercing contacts 16, and at the same time gas-tight contacting is brought about between the slit blade insulation piercing contacts 16 and the conductor 19 that deforms at the clamping point, as shown in detail in FIG. 26. Since the two slit blade insulation piercing contacts 16 are separate from one another—as will be described in further detail hereinafter—they form two connectors, spaced apart from one another longitudinally of the conductor, and as a result the conductor 19 is simultaneously contacted at four separate points, which are defined by the two insulation piercing slits 14. This assures especially effective contacting.

Figure 4:
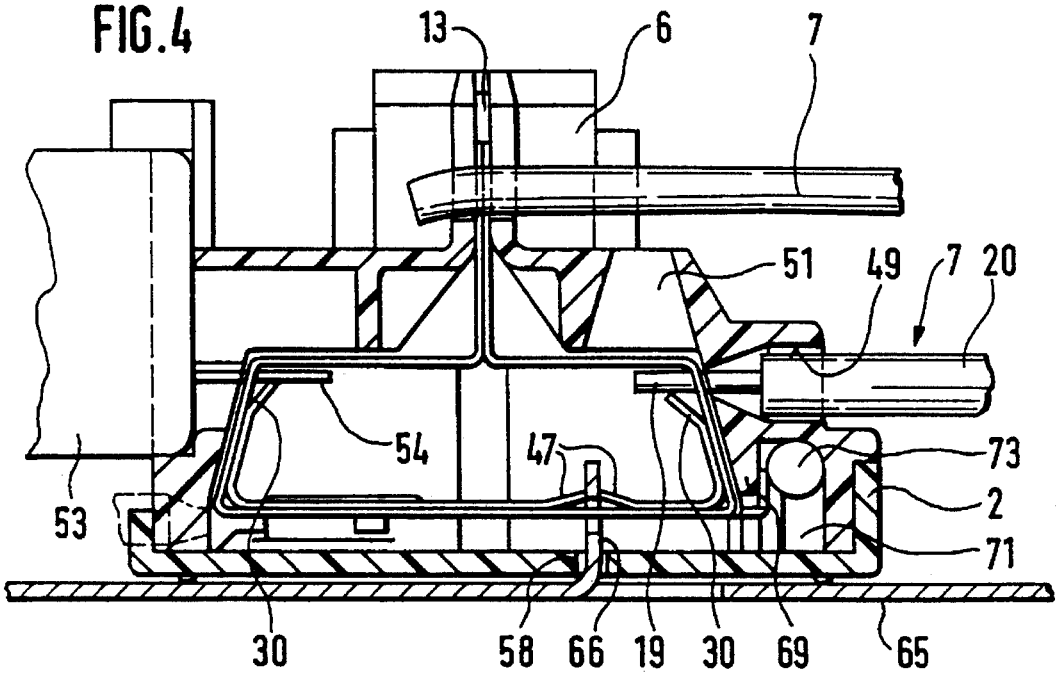
FIG. 4 is a sectional view corresponding to FIG. 3 of the connection structure of FIG. 1, showing the connection of two external wires and one capacitor.

With its insulation 20, the pressed-in conductor 19 is simultaneously firmly clamped in the insertion slit 9 between the two ribs 8. The thus-fixed connected wire 7 extends through one of the groovelike indentations 17, while its severed end rests in the other groovelike indentation 17, as shown in FIG. 4. The width and depth of the groovelike indentations 17 and their axial length are dimensioned such that automatic shock hazard protection is brought about for the severed end of the wire 7. This means that the standardized feeler finger, in the check for shock hazard protection, cannot penetrate as far as the bared, severed end at the depth of the associated groovelike indentation 17.

In the essentially hollow housing 1, four contact springs 21 (FIGS. 14–18) with clamping springs 22 (FIGS. 22–24) inserted into them are located underneath the connection terminals 5 and are associated with the various connection terminals 5.

Each of the contact springs 21 is bent in one piece from a strip of spring brass or spring bronze. They have an essentially trapezoidal lower part 23 (FIG. 14), which is defined by a flat bottom part 24, two inwardly inclined leg wedges 25 adjoining the bottom part laterally, and two upper wall parts 26 parallel to the bottom part 24. Adjoining the upper wall parts 26 are two tabs 27 bent upward at a right angle, which in the normal state rest against one another broadside, with slight initial stress, along the plane of symmetry (28). In the region of their upper periphery, the two tabs 27 are each provided with the insulation piercing slit 14 that is defined by the two legs 15. They form the two slit blade insulation piercing contacts 16 and in the installed state protrude from below into the two slits 13 of the respective connection terminal 5, in which they are guided laterally movably.

The clamping spring 22 (FIG. 22–24), shaped to fit the internal outline and essentially C-shaped, is inserted into the closed lower part 23 of the contact spring 21; its width is equal to that of the contact spring 21, and it rests flush, with a flat lower part 29 and two attached lateral legs 30, against the bottom part 24 and the legs 25 of the contact spring 21. The clamping spring 22 is of spring steel.

A rectangular recess 31 is formed in the left leg part 25, as seen in FIG. 26, of the contact spring 21, adjoining the upper wall part 26 at the top, while two side-by-side, approximately oval, continuous openings 32 (FIGS. 16, 17) are provided on the opposed leg part 25, likewise at the top. The recess 31 and the two openings 32 are covered by the two legs 30 of the inserted clamping spring 22; the leg 30 of the clamping spring 22 associated with the openings 32 is subdivided by a longitudinal slit 34 into two tonguelike parts movable independently of one another, each of which is associated with one opening 32.

The recess 31 and the openings 32 of the contact spring 21, together with the associated legs 30 of the clamping spring 22, form plug connectors, one of which, 31, 30, is arranged for connection of a solder lug or a blade connector, and the other two of which, 32, 30, are intended for the connection of two round wires or two stranded connectors, as will be described in detail hereinafter.

A securing protrusion 35 (FIG. 14) bent upward in an approximately L shape is bent out from the leg part 25, associated with the openings 32, of the contact spring 21 and forms an extension of the bottom part 24 on that side. In the bottom part 24 itself, a circular opening 36 is stamped out, which is adjoined by an openings 37 of rectangular cross section (FIG. 18), while on the other side, in the vicinity of the associated leg part 25, the bottom part 24 is provided with a tab 38 (FIG. 17) of approximately L-shaped cross section bent downward out of it. The tab 38 is located in the vicinity of a long edge of the bottom part 24 and is oriented parallel to its plane of symmetry. It is cut loose on both sides at 39, 40. As can be seen from FIGS. 22 to 25, a cut-loose, obliquely downwardly protruding locking tab 41 is provided on the clamping spring 22, in the region above the tab 38, and in the installed state cooperates with the L-shaped tab 38 of the contact spring 21 and with it forms a plug connector, which in the manner visible from FIG. 3 enables the connection of an inserted conductor 44. A pressed-in bead 46 serves as reinforcement.

A plug connector is likewise formed in the clamping spring 22 in the region above the rectangular opening 37 in the bottom part 24 of the contact spring 21, being formed by two locking tabs 47 bent inward and upward in inclined fashion and cut loose laterally. If a flat connection component is thrust from below through the opening 37 of the contact spring 21, then the two tabs 47 are spread apart on the inside; they accordingly lock to the thrust-in part in a manner known per se, so that this part can no longer be pulled out.

In the upper wall part 26 of the contact spring 21, finally, in the vicinity of the two openings 32, there is also a rectangular aperture 48 (FIG. 26), which is used for the introduction of a loosening tool, such as a screwdriver, in order to loosen the clamping of the conductor at this plug connector.

Two axially parallel, cylindrical wire insertion channels 49 are each formed on one side, below each connection terminal 5, in the base part 2 of the housing 1; each of these channels tapers in funnellike fashion to a coaxial bore 50, which leading into the inside of the housing is aimed at the associated opening 32 of the inserted associated contact spring 21.

As FIG. 4 shows, the insertion channel 49 receives the insulation 20 of an inserted wire 7, whose conductor 19, upon insertion through the opening 32 of the contact spring 21, has spread the associated leg part 30 of the clamping spring 22 inward, in such a way that it acts as a locking part and while simultaneously making contact prevents retraction of the conductor 19. The conductor 19 then rests flush against the upper wall part 26 of the contact spring 21, so that a satisfactory, large-area contact is assuredly made.

If the clamping is to be loosened, then a tool is introduced through the aperture 48 of the contact spring 21, (FIG. 25) through an opening 51 provided in the housing 1 next to the associated connection terminal, so as to press the inwardly spread leg part 30 resiliently downward, thereby releasing the conductor 19.

On the opposite side, the housing 1 has a centrally disposed, especially circular-cylindrical socket 52, located in a vertical plane, for an electrolyte capacitor 53 shown in FIG. 4. the electrolyte capacitor 53 is equipped with two conventional solder lugs 54 on its face end, which once the electrolyte capacitor 53 is inserted into the socket 52 protrude through the apertures 31, which are exposed to the outside via corresponding housing recesses, of the two associated contact springs 21 and are both pressed against and firmly locked to the upper wall part of the contact spring 21 by the legs 30 of the clamping spring 22 that are spread inward obliquely upon insertion. The thus-formed plug connectors for the solder lugs 54, like the opposed plug connectors for the conductors 19, are oriented with their (horizontal) insertion direction at right angles to the (vertical) insertion direction of the slit blade insulation piercing contacts of the connection terminals 5. They enable an especially space-saving, favorable arrangement of the capacitor 53, as well as of wires that extend below the wires 7 contacted in the connection terminals 5, and thus do not hinder the automatic placement and contacting of the wires 7 in the slit blade insulation piercing contact of the connection terminals 5.

Laterally next to the socket 25, on the front face end at the bottom in the housing 1, two further through channels 56 for conductors are formed, which in the manner visible at 44 in FIG. 3 are electrically conductively connected to the contact spring 21 via the tabs 38 and the locking tabs 41 of the contact and clamping springs 21, 22, respectively, via a plug connection.

Figure 9:
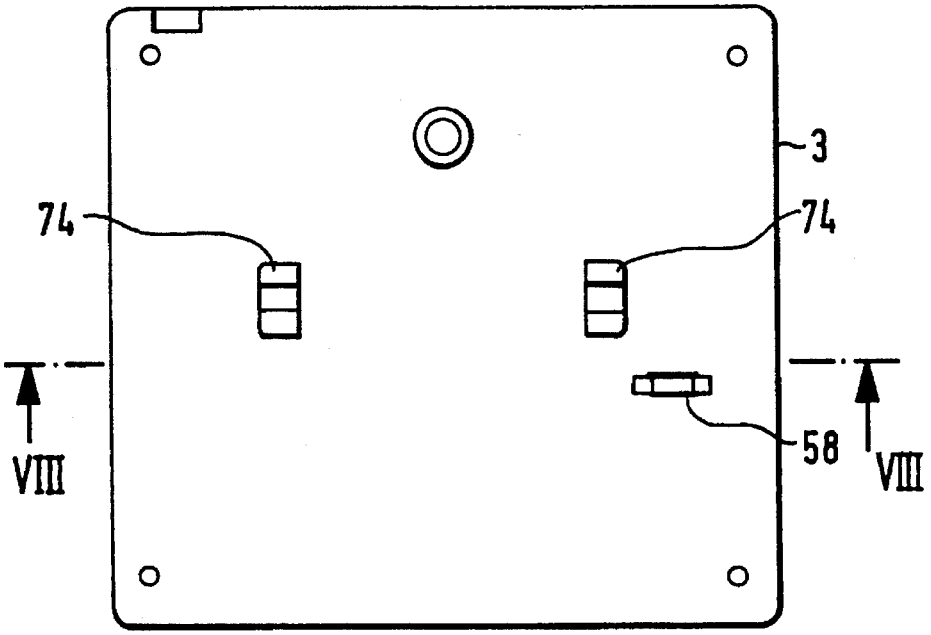
FIGS. 9 and 10 are a side view and an inside view, respectively, of the cover of FIG. 8.
Figure 10:
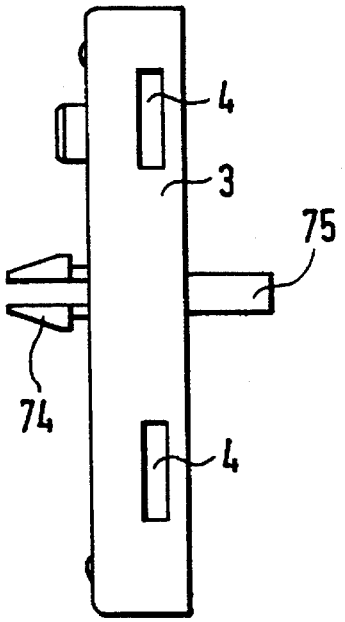
Figure 11:
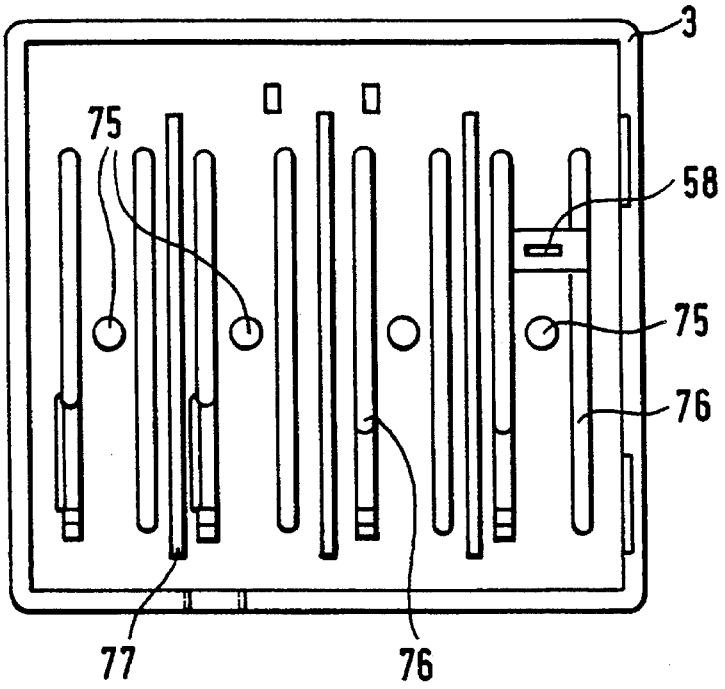
FIGS. 11–13 are a plan view and a side view, respectively, of a contact spring bow of the closure part of the connection structure of FIG. 1.

A grounding strap 59, inserted from below through a corresponding slit 58 in the cover 3 (FIG. 9), which is retained between the inwardly spread-apart locking tabs 47 (FIG. 3), makes it possible to connect the contact spring 21, associated with the grounding line, to a metal housing part or to its own ground connection.

The grounding strap 59 is shown in detail in FIGS. 19–21. It has a narrow insertion lug 61, which is slightly pointed at the end at 62 and which, on the adjoining widened portion 63, is provided with two cut-loose locking tabs 64, which are bent slightly laterally out of the plane of the grounding strap 59, as shown particularly in FIG. 20. They make it possible for the grounding strap 59 to be locked in detent fashion in a slitlike opening of the bottom of the apparatus.

Alternatively, as shown in FIG. 4, a cut-loose grounding tab 66 may also be provided directly in the metal bottom part 65 of an apparatus, such as an electric light fixture or luminaire, and this grounding tab Is bent upward at a right angle and mounted on the connection structure during installation in such a way that it protrudes inward through the opening 58 in the cover 3 and is locked in the manner already described, while simultaneously making contact, at the locking tabs 47 of the clamping spring 22.

Figure 6:
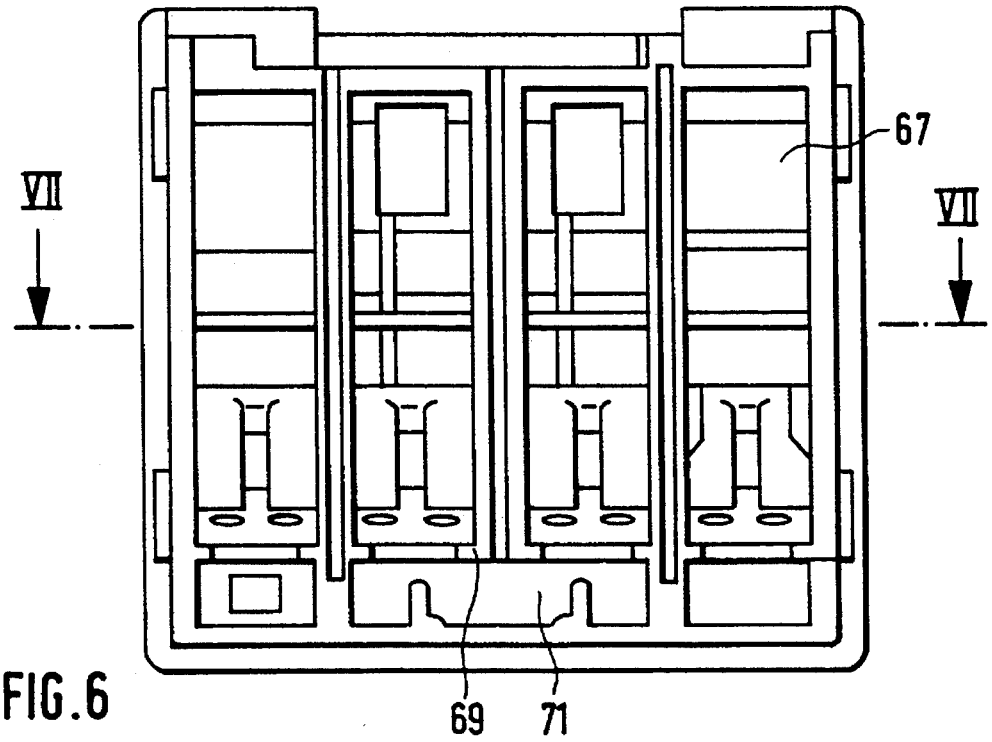
FIG. 6 is a plan view on the bottom of the housing of the connection structure of FIG. 1, with the contact springs removed.
Figure 7:
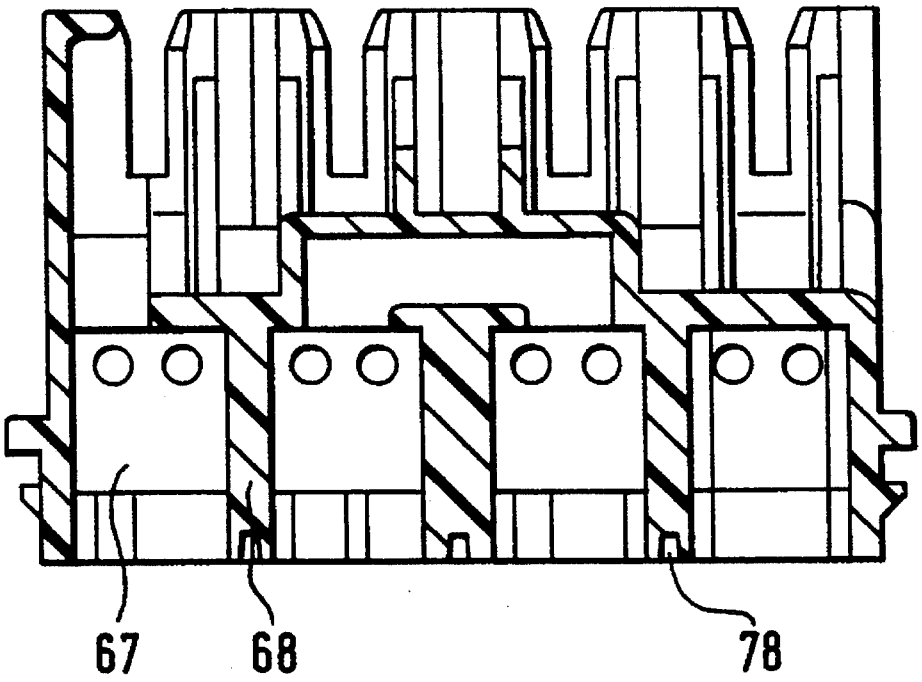
FIG. 7 is a side view, in a section taken along the line VII—VII of FIG. 6, of the housing of the connection structure of FIG. 1.

As can be learned from FIGS. 6, 7, for instance, chambers 67 are formed, side by side, in the housing 1 below the connection terminals 5; they are separated from one another by formed-on parallel partitions 68. Each of the chambers 67 receives on contact spring 21 with the inserted clamping spring 22, in the manner visible from FIGS. 3 and 4. The inserted contact springs 21 then, with their fastening protrusion 35 (FIG. 14), each fit over one transversely extending end wall 69 of the housing and protrude into a transverse channel 71, located inside the base 2 in front of the end wall 69, and this channel is also closed off at the bottom by the cover 3 mounted in place.

A shunt resistor for the capacitor 53 may be located in the channel 71, for example; it is formed as a cylindrical circuit element with metal connection caps mounted on its ends and is shown at 73 in FIG. 4. The shunt resistor 73 is inserted in such a way that its two connection caps are held in electrically highly conductive connection with the fastening protrusions 35 of adjacent contact springs 21.

Instead of the shunt resistor 73, some other circuit element, such as a fine-wire fuse, or fuse for feeble currents, could also be provided, which could optionally be replaceable through a lateral opening in the base 2 and the cover 3.

Figure 8:
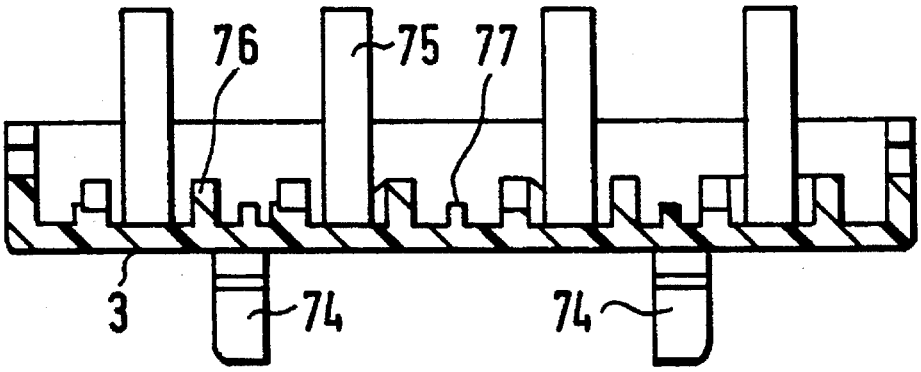
FIG. 8 is a side view in section, taken along the line VIII—VIII of FIG. 9, of the cover of the housing of the connection structure of FIG. 1.

Parallel cylindrical support prongs 75 are formed on the inside, in the manner shown particularly in FIGS. 3, 8, of the cover 3 that on its outside has detent feet 74 acting as fastening elements; in the installed state, these prongs 75 protrude through the central hole 36 (FIG. 18) of the respective contact and clamping springs and on the face end support the two tabs 27 of the contact spring 21 that form the clamping contacts 16. This support prevents the contact springs 21 from deflecting downward when a conductor 19 is inserted into the insulation piercing slits 14.

The cover 3 also has lengthwise ribs 76 formed onto its inside and springs 77 parallel to them that are disposed in such a way that in the installed state the lengthwise ribs 27, in addition to the partitions 68 of the housing 1, axially support the contact springs 21, while the springs 77 engage corresponding grooves 78 on the face ends of the partitions 68, in order to protect the arrangement from leakage paths between adjacent contact springs 21.

Figure 2:
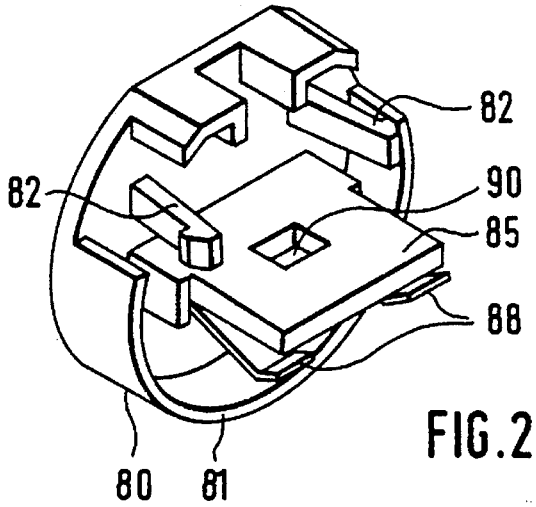
FIG. 2 is a perspective view of a closure part of the connection structure of FIG. 1.

The socket 52 (FIGS. 1, 4) laterally formed onto the housing and forming a receiving and connection region for the capacitor 53, is closed, in applications in which no capacitor 53 is used, by a cap-shaped closure element 80 (FIGS. 2, 3), which is inserted into the socket 52 and guided in it by a cylindrical protrusion 81. Two detent hooks 82 are formed onto the inside of the closure element 80 and fit over corresponding housing parts 84 at the socket 52. The closure element 80, which in the mounted state covers the two contact springs 21, which are partly exposed on their face ends in the socket 52, in a way protected again shock hazard is also provided on its inside with a formed-on plate 85, which on the inserted state protrudes into a corresponding slitlike opening 86 above the two associated contact springs 21, as can be seen particularly in FIG. 3.

Figure 12:
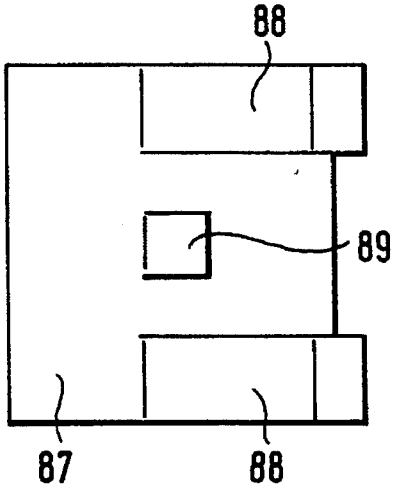
Figure 13:
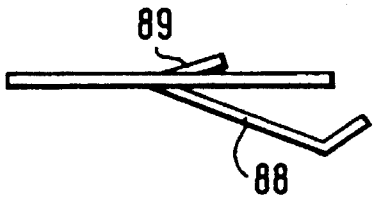
Figure 25:
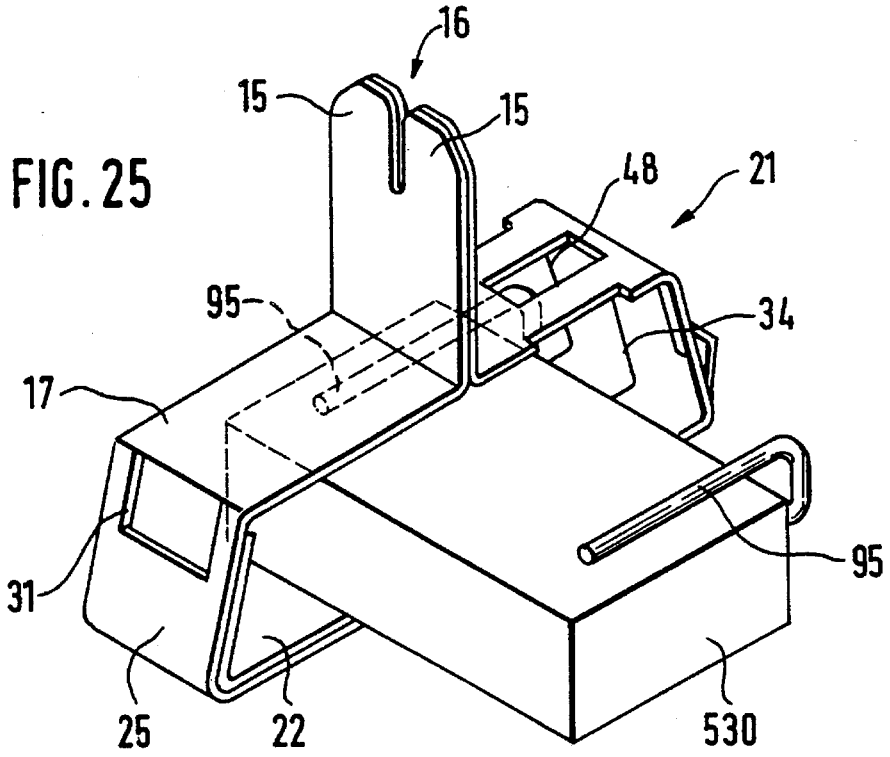
FIG. 25 is a schematic perspective view of a contact spring of FIGS. 14–18 with an inserted clamping spring and an inserted capacitor.

A contact bridge 87 (FIGS. 12, 13), made of resilient sheet brass, is located on the-underside of the plate 85 and on its side has two parallel cut-loose contact prongs 88, which as can be seen from FIG. 13 are curved obliquely downward and bent on the ends. A likewise notched detent tab 89 engages a central opening 90 of the plate 85 and keeps the contact bridge 87 stationary.

It can be seen particularly in FIG. 3 that in the inserted state of the closure element 80, the two contact prongs 88 of the contact bridge 87 are pressed with initial stress at the top onto the adjacent contact springs 21 exposed at the top in the opening 86; the consequence is that via the contact bridge 87, a secure electrical connection is established between these two contact springs 21 and hence the associated connection terminals 5.

When the connection structure is use for wiring a fixture or luminaire with gas discharge lamps, the closure element 80 thus makes it possible to connect not only the power supply network conductors L and N but also the grounding conductor (on the contact spring 21 opposite the slit 58 in the cover 3) while on the other hand a selective wiring option for the fixture exists in that the fixture can be operated either uncompensated or compensated with a capacitor parallel to the network or capacitively with a series connection capacitor, without having to provision additional wiring layouts from outside. At the same time, if necessary, an anti-interference capacitor may also be connected, which is inserted by its two connection wires simply through the insertion channels 56 (51) into the plug connections that are formed by the two tabs 38 (FIG. 3, 18).

In an alternative embodiment, the closure element 80 may also be formed such that it has circuit elements on its inside, for instance a fine-wire fuse or an anti-interference capacitor, whose connection elements are arranged for insertion into the recesses 31 of the two Contact springs 21 exposed on the socket 52. The arrangement may also be such that these circuit elements are secured to the housing 1 inside the socket 52, while the closure element 80 merely retains them and covers them from the outside.

The embodiment of the receiving and connection region in the form of the socket 52 is not limited to the connection of a capacitor 53 with a cylindrical cup. Instead, it is adapted to the particular form of circuit element to be connected and spatially attached.

An alternative option for providing a capacitor 530 or other circuit element, such as a resistor, is suggested in FIG. 26. The capacitor 530, in this case essentially block-shaped, is inserted into the space surrounded by the lower part 23 of two adjacent contact springs 21; its two connection wires 95 are bent upward in a U, such that between the top of the capacitor 530 and the inside of the upper wall parts 26 of the contact springs 21, they are clamped with an initial tension that is required for making good contact.

For mechanical retention of the capacitor 530, the partitions 68 of the housing 1 (FIG. 7) and the ribs 76 of the cover 3 (FIG. 8) are suitably recessed or shaped, while the support prongs 75 for the two contact springs 21 are omitted, and the axial support of the slit blade insulation piercing contacts 16 is provided directly by the inserted capacitor 530.

When the novel connection structure is used in automatic production of wiring layouts, to enable easy identification of the various connection terminals 5, they are provided with a code, which for instance may be a dot code provided on the face end, as suggested in FIG. 1 at 100 for one connection terminal 5.

The connection structure may also be formed such that it directly enables the looping through of wires, as may sometimes be needed in the production of wiring layouts. To that end, between adjacent connection terminals 5, for instance, at least one through channel 96 (FIG. 5) may be formed, although it is also possible to provide corresponding devices in the base 2 or other housing parts.

Finally, embodiments in which in addition to or instead of at least one of the plug contacts at 30, 32, a screw-type clamp connection is provided on the connection side, or in which the plug connection is joined via an adapter (connecting strap or connecting line) to a screw-type clamp.

The closure means 80, 3 may be formed so as to be lockable to the housing 1, but other closure options are also possible, for instance via screw or bayonet mounts.

In a preferred embodiment, electrical connecting means 87 for bridging two plug connectors located in the receiving or connection region are associated with the closure means 80, so that with the insertion of the closure means, an internal connection of various connection points in the connection structure is brought about. Particularly in producing the wiring of fixtures or luminaires, further economy, in terms of separate connection points for wires to be placed, can be attained in this way.

Advantageously, insertion channels 49, 50; 56 for the conductive parts to be connected are associated with the plug connectors in the housing 1, and in these channels these parts, optionally including an applied insulation 20, can be received over part of their length, thus assuring satisfactory insulation, protected against shock hazard, in the contact region without requiring additional provisions. To make it easier to insert the conductive part to be connected, one such insertion channel 50 may be formed as widening in funnel-like fashion toward the outside.

Depending on the design of the apparatus and the associated wiring, it may be advantageous if at least one plug connector at 47 is formed with an insertion direction oriented parallel to the insertion direction of the slit blade insulation piercing connector 16. The connection structure can have at least two plug connectors 31; 32 that are accessible from opposite sides of the housing 1, so as to assure the most space-saving possible arrangement of one or more devices or wires to be connected.

In the practical embodiment, the contact means of the connection structure can have at least one contact spring 21 of electrically highly conductive material, in which the slit blade insulation piercing connector 16 and the plug connector or connectors 31, 32, 47 are formed. In this way, with relatively simple means, particularly good contacting at the slit blade insulation piercing can be attained, if this slit blade insulation piercing connector 16 is formed by two parallel contact spring parts 27, unjoined over their length, in which two slit blade insulation piercing slits 14 aligned with one another are located, wherein that both contact spring parts 27 are laterally guided in the housing 1. Each of the two contact spring parts in fact produces two separate connectors, so that the connected conductor is contacted via a total of four separate connectors.

In an advantageous embodiment, the contact spring 21 can have a bottom part 24 and two opposed leg parts 25, protruding from that bottom part, which in at least one part 24, 25 form a plug contact opening 31, 32, 47 that is at least partly covered by a locking part 30, 22 that is lockable to a plugged-in part 54, 19, 59. This locking part may be formed on the contact spring itself in the form of one or more cut-loose tabs, which when a part is plugged in spread apart and are locked to it in detent fashion. It is also possible, however, for a clamping spring 22, which has locking parts 30, 47 cooperating with the respective contact opening 31, 32, 37, to be inserted into the contact spring 21. To that end, the clamping spring 22, in the region of at least one contact opening 37 of the contact spring, can have a plug opening that is defined by spreadable notched locking tabs 47 cut loose on the ends. Another option is for an essentially flat part 24 of the contact spring 21 to have a substantially L- or U-shaped region 38 forming a plug connector and pressed from outside out of the plane of this part 24; a locking part 41 optionally formed on the aforementioned clamping spring protrudes into this region. Moreover, in the region containing the bottom and leg parts 24; 25, the contact spring 21 can be formed as substantially completely closed all the way around by upper wall parts 26, with the parts 27 carrying the slit blade insulation piercing slits 14 notched at the upper wall parts 26.

In the novel connection structure, as a rule, a plurality of contact springs 21 are located in the housing 1 in their own chambers 67, which are separated from one another by insulating partitions 68 and are closed by a common cover 3. This cover may be omitted if the housing, when installed, is seated directly on an insulating substrate, so that the contact means are closed off from the outside in a manner protected against shock hazard from this side as well.

The cover can be located on the side of the housing opposite the slit blade insulation piercing connectors 16 and has support means 75 for parts 27 of the contact means forming the slit blade insulation piercing contacts. The cover 3 and/or the housing or the partitions 68 in it may be provided with intermeshing parts 77, 78; 76 that prevent leakage paths, and it is also possible for the housing 1 and/or the cover 3 to have at least one through channel 96 for a conductor looped through it.

As already noted at the outset, particularly in use for fixtures or luminaires, it is advantageous if the connection structure is arranged for use with a capacitor 53, 350 as an accessory device, and the housing 1 has form-locking retaining means 52, for the capacitor in the aforementioned receiving or connection region. In addition or alternatively, however, the arrangement may also be such that a capacitor, resistor or at least one other component is accommodated in the housing itself, and it is an attractive option to accommodate them in the space enclosed by the applicable contact spring.

The connection structure may also have connection points arranged for the connection of fine-wire fuses or a shunt resistor, for instance, and these connection points are either formed as plug connectors or are located inside the housing itself.

The novel connection structure is universally usable. It can in particular advantageously be used in the automatic production of the wiring of fixtures or luminaires, but its use is not limited to that field.

Various changes and modifications may be made, and any features described herein in connection with any one embodiment may be used with any of the others, within the scope of the inventive concept.

We claim:

1. A connection structure format least one electrical device (53), optionally a capacitor, comprising a housing (1) of electrically insulating material, said housing being formed with attachment means (74) for attachment to a support;

spatially separated electrical connection points (16, 31, 32, 38) for electrically conductive parts;

contact means (21, 22) electrically conductively joined to said connection points, at least one (16) connection point being formed as a slit-blade insulation-piercing connector, and at least one other (31, 32, 38) connection point being formed as a plug or push-in connector;

a reception region, including socket (52), for said electrical device (53) formed on said housing, at least one (31) of said connection points being located in the reception region (52); and shock-protection means (17, 49, 50, 56) formed from portions of said electrically insulating housing (1) protecting each of said connection points (16, 31, 32, 38) against accidental and undesired electrical contact.

2. The connection structure of claim 1, characterized in that at least one plug connector (31) is arranged for the insertion of a solder lug or a blade connector.

3. The connection structure of claim 1, characterized in that it has two plug connectors (31), located side by side, which are arranged for insertion of a solder lug or blade connector and each of which is electrically conductively joined to its own slit blade insulation piercing connector (16).

4. The connection structure of claim 1, characterized in that it has at least one plug connector (31, 32, 38), whose insertion direction is formed at right angles to the insertion direction of the slit blade insulation piercing connector (16).

5. The connection structure of claim 1, wherein at least one further reception region (71, 23) is formed on the housing (1) for reception of a further device (73, 530); and at least one connection point (35, 26) is located in said further reception region.

6. The connection structure of claim 5, characterized by contact connectors (35) on the housing (1) arranged for connection of a shunt resistor (73).

7. The connection structure of claim 5, comprising detachable closure means (80, 3) covering the further reception region for insulating said further reception region with respect to the outside of the structure.

8. The connection structure of claim 7, characterized in that the closure means (80, 3) are formed so as to be lockable to the housing (1).

9. The connection structure of claim 7, further comprising electrical connection means (87), associated with said closure means (80), said electrical connection means bridging two connection points.

10. The connection structure of claim 1, further including insertion channels (49, 50; 56) for said electrically conductive parts, which parts are adapted to be connected to, and associated with said plug connections (31, 32, 38), said insertion channels being dimensioned to receive said conductive parts, optionally including insulation (20) applied thereover.

11. The connection structure of claim 10, characterized in that at least one insertion channel (50) is formed in widening or funnellike fashion outwardly from the housing.

12. The connection structure of claim 1, characterized in that at least two plug connectors (31; 32) are provided, respectively accessible from opposite sides of the housing (1).

13. The connection structure of claim 1, characterized in that at least one plug connector is formed with an insertion direction oriented parallel to the insertion direction of the slit blade insulation piercing connector (16).

14. The connection structure of claim 1, characterized in that the contact means have at least one contact spring (21) of electrically highly conductive material, in which material the slit blade insulation piercing connector (16) and the plug connector or connectors (31, 32, 47) are formed.

15. The connection structure of claim 14, characterized in that the contact spring (21) has an essentially flat part (24), which flat part includes a region (38) of substantially L or U shape forming one of said plug connectors, pressed from outside out of the plane of said flat part (24); and in that a locking part (41) is provided, protruding into said one of said plug connectors.

16. The connection structure of claim 14, characterized in that the at least one (21) contact spring has a bottom part (24) and two opposed leg parts (25), protruding from the bottom part, which in at least one part (24, 25) form a plug contact opening (31, 32, 47) that is at least partly covered by a locking part (30, 22), which locking part is lockable to an element (54, 19, 59) that is to be inserted into the plug contact opening.

17. The connection structure of claim 16, characterized in that the contact spring includes a clamping spring (22), which has said locking parts (30, 47) cooperating with the respective contact opening (31, 32, 37).

18. The connection structure of claim 17, characterized in that the clamping spring (22), in the region of at least one contact opening (37), has a plug opening that is defined by notched locking tabs (47) which tabs can be spread apart on one side.

19. The connection structure of claim 14, wherein the slit blade insulation piercing connector (16) is formed by two parallel contact spring parts (27), unjoined over their length, in which two slit blade insulation piercing slits (14) aligned with one another are located; and the housing (1) is formed with means for laterally guiding both contact spring parts.

20. The connection structure of claim 19, characterized in that the contact spring (21), in the region containing the bottom and leg parts (24; 25), is formed as a substantially circumferentially closed structure, including upper wall parts (26); and in that, at the upper wall parts (26), the portions (27) carrying the slit blade insulation piercing slits (14) are notched.

21. The connection structure of claim 1, characterized in that the contact means (21, .22) include a plurality of contact springs (21), located in the housing (1), said housing being formed with a plurality of chambers (67), which are separated from one another by insulating partitions (68), each chamber retaining a contact spring (21).

22. The connection structure of claim 21, characterized in that a cover (3) is provided common to at least one of said chambers; and in that the cover is located on the side of the housing opposite the slit blade insulation piercing connector (16) and has support means (75) for portions (27) of the contact means forming the slit blade insulation piercing contacts.

23. The connection structure of claim 21, characterized in that at least one of the cover (3) and the partitions (68) have intermeshing parts (77, 78; 76) to prevent leakage paths.

24. The connection structure of claim 21, characterized in that at least one of the housing (1) and the cover (3) has at least one through channel (96) to permit a conductor being pulled through it.

25. The connection structure of claim 1, characterized in that the reception region has mechanical holding or retaining means (52, 3) for the device (53).

26. The connection structure of claim 25, wherein said device (53) comprises a capacitor (53, 350), and the housing (1) has form-locking retaining means (52, 3) for the capacitor in the reception region.

27. The connection structure of claim 14, including at least one electric device (530), located in a region that is at least partially encompassed by at least one contact spring (21).

28. The connection structure of claim 27, characterized in that the slit blade insulation piercing connector (16) of the contact spring (21) is electrically connected to the electric device (530) and is mechanically supported via said device (530).

* * * * *